US006561250B2

(12) United States Patent
Hutchins

(10) Patent No.: US 6,561,250 B2
(45) Date of Patent: May 13, 2003

(54) DISPLAY DEVICE

(75) Inventor: Joseph Hutchins, Killingworth, CT (US)

(73) Assignee: Chanel, Inc., New York, NY (US)

( * ) Notice: Subject to any disclaimer, the term of this patent is extended or adjusted under 35 U.S.C. 154(b) by 0 days.

(21) Appl. No.: 09/925,843

(22) Filed: Aug. 8, 2001

(65) Prior Publication Data

US 2003/0037887 A1 Feb. 27, 2003

(51) Int. Cl.[7] ..... E06B 3/32
(52) U.S. Cl. ..... 160/89; 160/122; 40/486
(58) Field of Search ..... 160/89, 122, 87, 160/88; 40/486, 487, 470, 437; 359/450

(56) References Cited

U.S. PATENT DOCUMENTS 1,213,388 A * 1/1917 Loftus
1,218,979 A * 3/1917 Cahill
1,337,315 A * 4/1920 Harvey
1,857,368 A * 5/1932 Flynn et al.
1,857,673 A * 5/1932 Vallen
1,882,828 A * 10/1932 Hall et al.
3,926,242 A * 12/1975 Lowe

* cited by examiner

*Primary Examiner*—Blair M. Johnson
(74) *Attorney, Agent, or Firm*—Darby & Darby

(57) ABSTRACT

A display device includes a frame, a first screen, a second screen, a third screen and a fourth screen. The first and second screens each have a distal end that is movable generally in a first direction between a first limit position and a second limit position. The third and fourth screens each have a first distal end that is movable generally in a second direction between a first limit position and a second limit position. The second direction is at an angle with respect to the first direction. Tension is applied in the first direction to each of the first distal end of each of the first screen and the second screen in a direction away from the respective second proximal end. A first guide channel is fixedly connected to an upper portion of the frame. A second guide channel is fixedly connected to a lower portion the frame. A first and second set of support carriers, each having at least one roller, are rotatably received in the first and second guide channels, respectively. A spring connects one of the first set of support carriers to the top end of the first screen, and one of the second set of support carriers to the bottom end of the first screen. The springs are in tension so that at least one roller of each of the support carriers of the first set maintain contact with the first guide channel and at least one roller of each of the support carriers of the second set maintain contact with the second guide channel.

31 Claims, 13 Drawing Sheets

DISPLAY DEVICE

BACKGROUND OF THE INVENTION

1. Field of the Invention

The present invention relates to a display device. More specifically, the present invention relates to a display device having a window and four independently moveable screens to selectively reveal only preselected merchandise while other merchandise in the window is partially or completely hidden from view by the screens.

2. Discussion of the Related Art

Displays have been used for decades in stores to attempt to draw the attention of consumers to certain merchandise. Some displays, such as those disclosed in U.S. Pat. No. 1,213,388 to Loftus and U.S. Pat. No. 1,337,315 to Harvey, include the use of rigid panels to selectively display certain merchandise to a consumer. However, to moving the rigid panels of these displays is very cumbersome, awkward and creates a lot of noise. Thus, there is a need in the art for an advertising display devise that is easy to use and moves the screens in quiet manner so as to not detract from the merchandise being displayed. Accordingly, it is an object of the present invention to provide such a display device.

SUMMARY OF THE INVENTION

These and other objects are achieved in accordance with a currently preferred exemplary embodiment of the present invention in which a display device includes a frame, a first screen, a second screen, a third screen and a fourth screen. The first and second screens each have a distal end that is movable generally in a first direction between a first limit position and a second limit position. The third and fourth screens each have a first distal end that is movable generally in a second direction between a first limit position and a second limit position. The second direction is at an angle with respect to the first direction. In accordance with one aspect of the present invention, tension is applied in the first direction to each of the first distal end of each of the first screen and the second screen in a direction away from the respective second proximal end. In accordance with another aspect of the present invention, a first guide channel is fixedly connected to an upper portion of the frame. A second guide channel is fixedly connected to a lower portion the frame. A first and second set of support carriers, each having at least one roller, are rotatably received in the first and second guide channels, respectively. A spring connects one of the first set of support carriers to the top end of the first screen, and one of the second set of support carriers to the bottom end of the first screen. The springs are in tension so that at least one roller of each of the support carriers of the first set maintain contact with the first guide channel and at least one roller of each of the support carriers of the second set maintain contact with the second guide channel.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
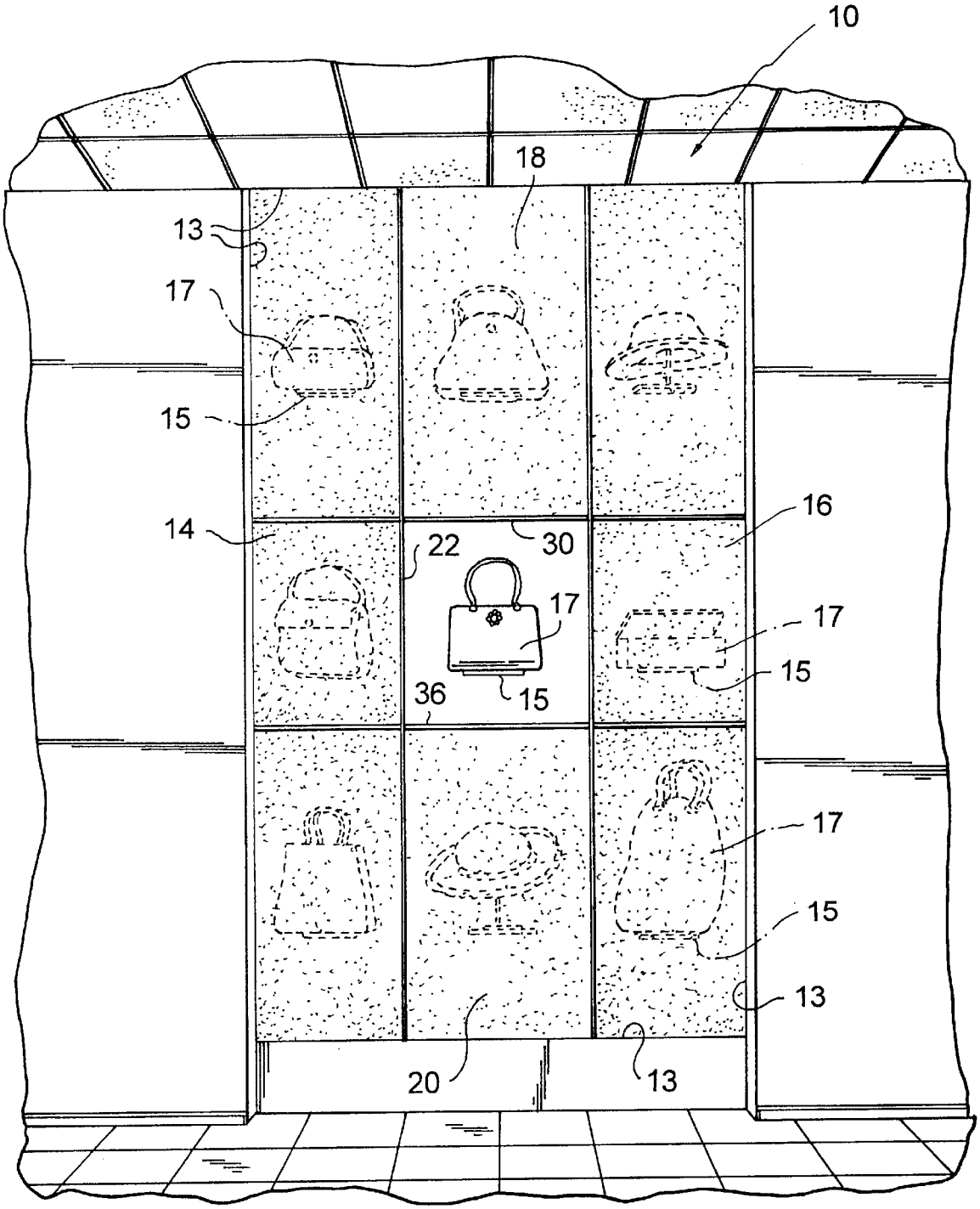
FIG. 1 is a front plan view of the advertising display device in accordance with the present invention.

Referring now to FIGS. 1–16, a display device 10 in accordance with the present invention is illustrated. The display device 10 is preferably set up as an advertising display in a store to systematically display certain portions of a display window so that only certain merchandise, as desired, is revealed to the customer. The remaining merchandise will remain behind movable screens that partially or completely block their view depending upon the desires of the user. The screens could then move to reveal different merchandise. The screens can be moved in a predetermined manner to cyclically reveal the merchandise, or may be moved randomly.

Display device 10 includes a frame 12, a first screen 14, a second screen 16, a third screen 18, and a fourth screen 20. Frame 12 includes a window 13. A plurality of platforms 15 are placed in predetermined locations within window 13 for receiving merchandise 17. In the illustrated embodiment, nine platforms 15 are selectively hidden from view, each containing an individual merchandise 17, such as a purse, hat, jewelry, etc. Of course, more or less platforms may be used, and more or less merchandise may be placed on each platform. Screens 14, 16, 18, 20 are moveable linearly so that only preselected merchandise is exposed through window 13. The remaining merchandise remains behind the screens. The screens are preferably made of a flexible fabric that is approximately 10% open so that a customer can see partially through the fabric so that the merchandise behind the screen is seen as a shadow in outline format. One such fabric is available from Mermet Co. of Cincinnati, Ohio, as screen model no. 5110, and is made of vinyl with fiberglass.

Lights 19 may be used to illuminate the merchandise and enhance their appearance.

Figure 5:
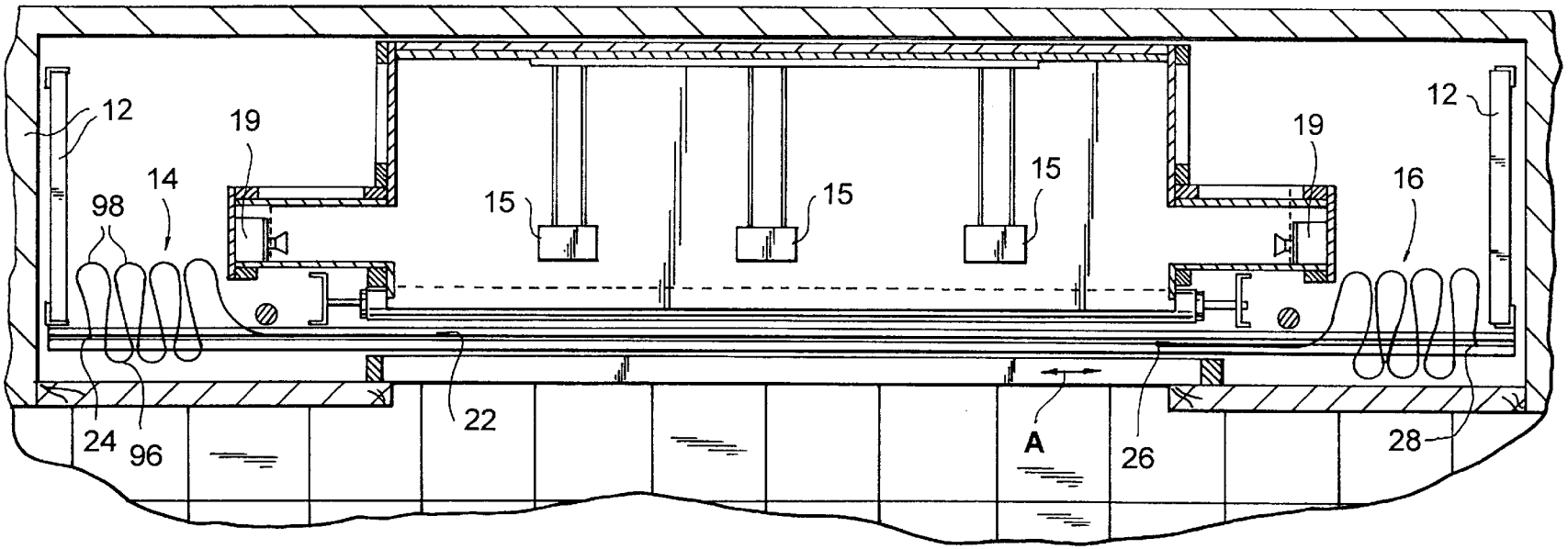
FIG. 5 is a cross-section view taken along line 5—5 of FIG. 2 and looking in the direction of the arrows.

First screen 14 has a first distal end 22 and a second proximal end 24. As illustrated in FIG. 5, the second proximal end 24 of screen 14 is connected to frame 12. First distal end 22 of screen 14 is slidably connected to frame 12 and is movable generally in a first direction, which is indicated by arrow A in FIGS. 2 and 5 between a first limit position, which is approximately shown in FIG. 5 and a second limit position, which is not shown in the drawing figures, but which approximately corresponds to a location of the first distal end 26 of second screen 16 as shown in FIG. 5.

Figure 2:
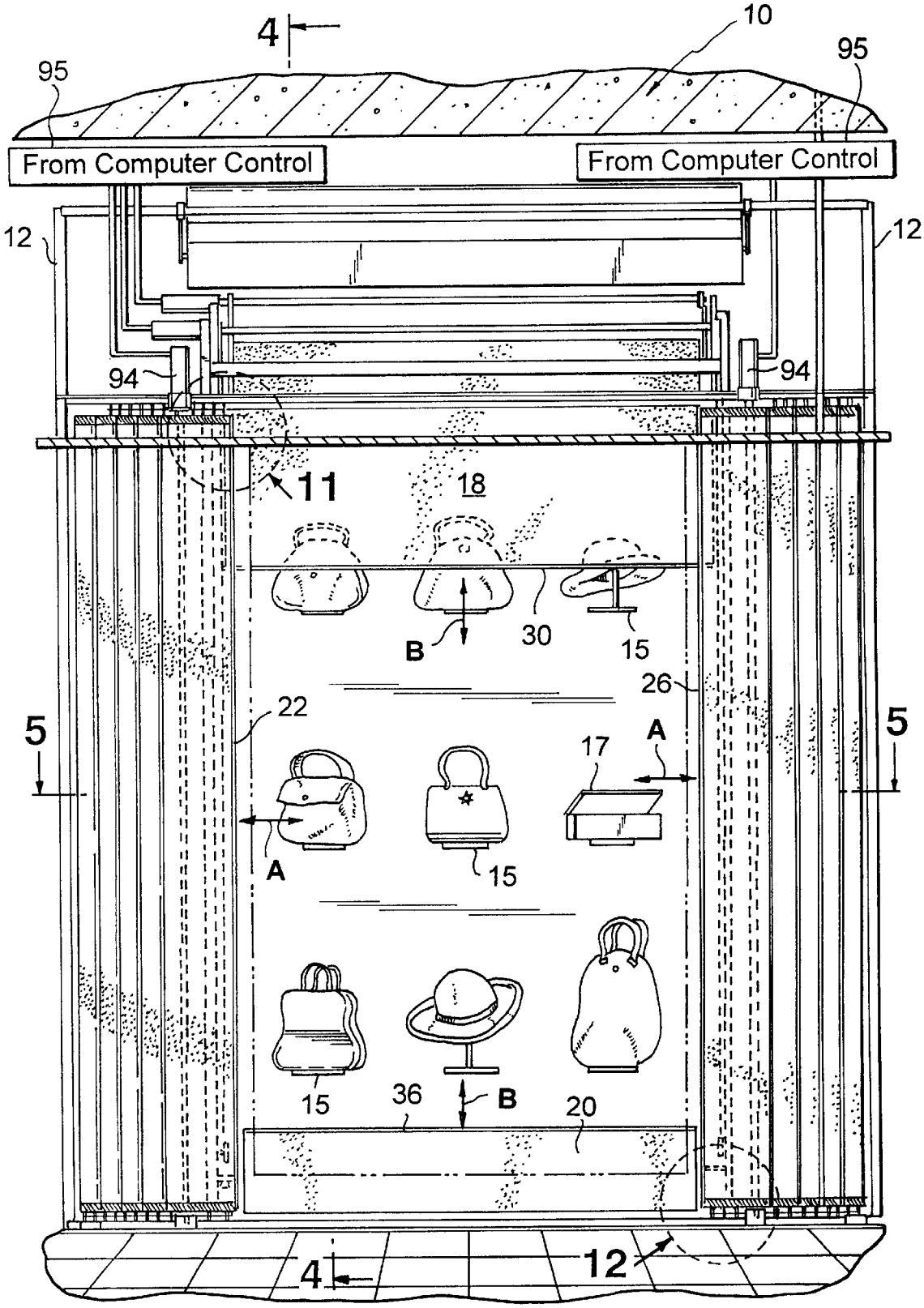
FIG. 2 is a front plan view of the display device, with some obstructions removed for the sake of clarity.

Second screen 16 has a first distal end 26 and a second proximal end 28. Second proximal end 28 is connected to frame 12. First distal end 26 is movable generally in first direction A between a first limit position as illustrated in FIGS. 2 and 5, and a second limit position. Similar to screen 14, screen 16 moves from its first limit position towards its second limit position, which approximately corresponds to a location of the first limit position of screen 14. Of course, the full distance that screens 14, 16 extend in direction A is to be determined by the needs of the user. Screens 14, 16 may extend from one end of window 13 to the other, or may, for example, extend from one end across about 65–75% of the window as shown in FIG. 1.

Figure 3:
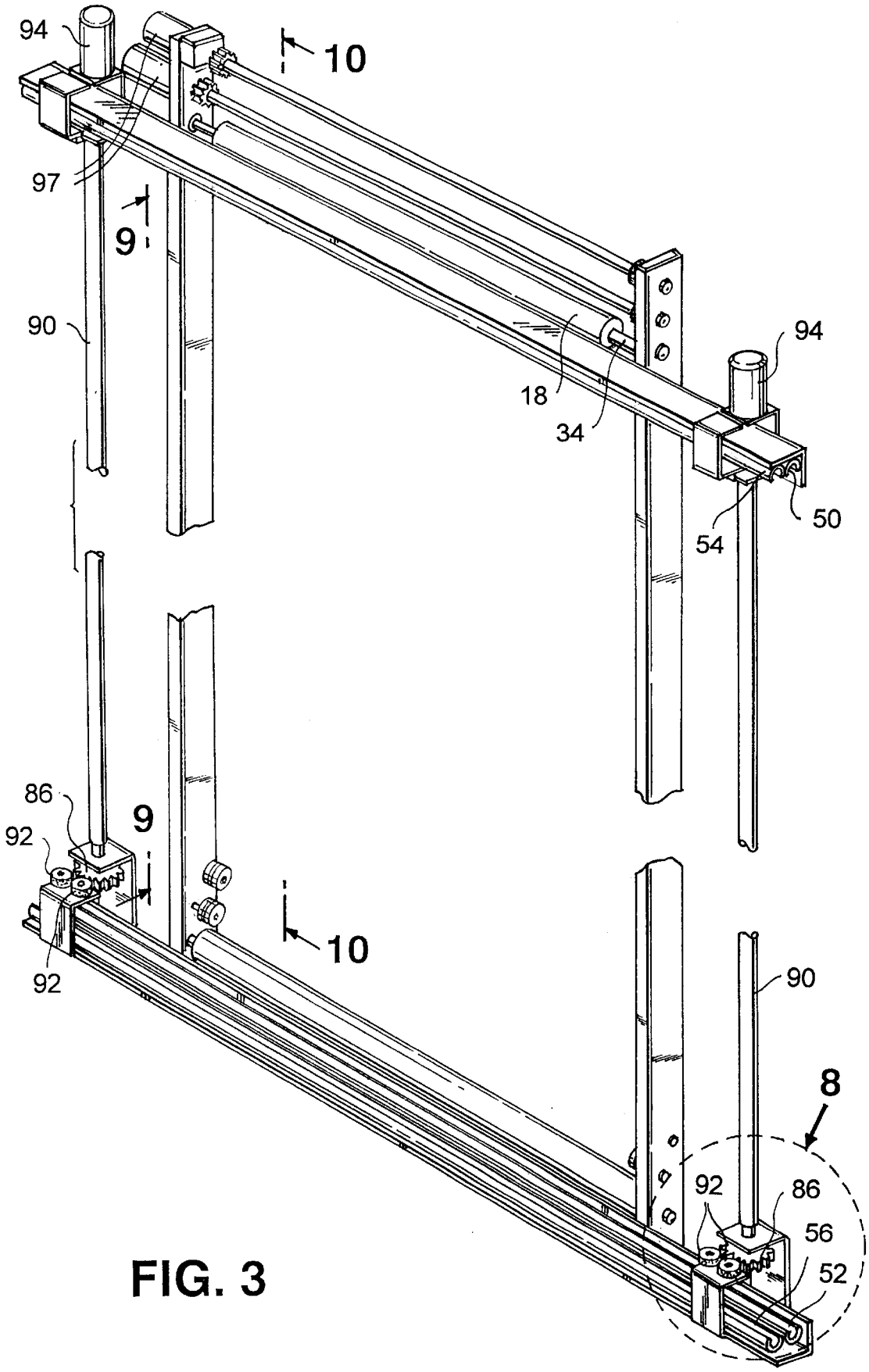
FIG. 3 is a perspective view of a portion of the frame of the display device for supporting the shades and curtains.
Figure 4:
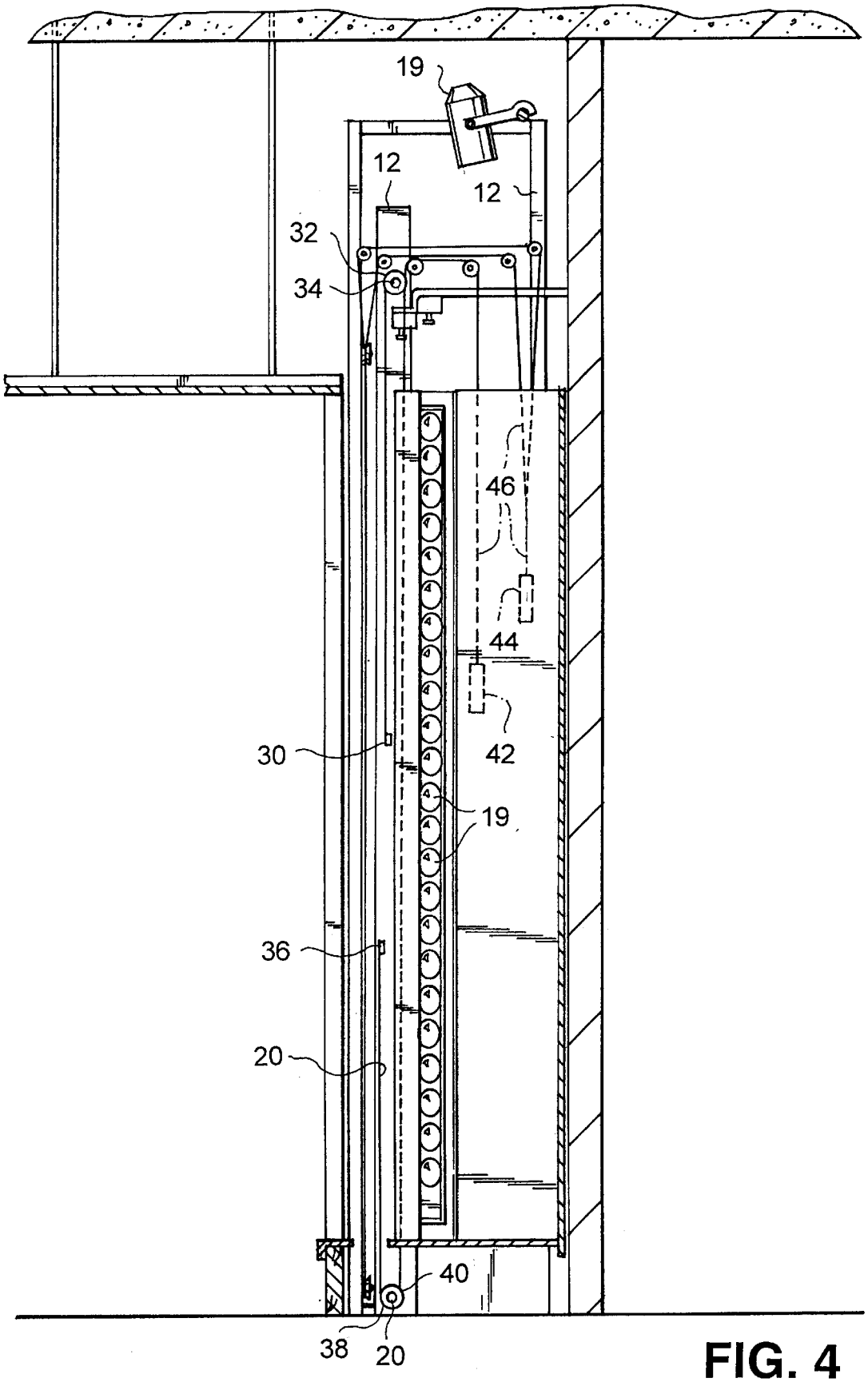
FIG. 4 is a cross-sectional view taken along line 4—4 of FIG. 2 and looking in the direction of the arrows.

Third screen 18 has a first distal end 30 and a second proximal end 32. Referring now to FIGS. 2–4, second proximal end 32 of third screen 18 is connected to frame 12. More specifically, second proximal end 32 is fixedly connected to rotatable shaft 34. First distal end 30 of third screen 18 is movable generally in a second direction indicated by arrow B between a first limit position and a second limit position. Thus, third screen 18 wraps around shaft 34 similar to how a window shade accumulates around its rotatable center shaft. As illustrated in FIG. 2, first direction A is approximately at a right angle with respect to second direction B. However, these angles could be other angles depending upon the needs of the user. In addition, more than four screens may be used, once again, depending upon the needs of the user. For example, six screens could be used with each set of screens moving linearly at a 60° angle offset from the adjacent screen.

Fourth screen 20 has a first distal end 36 and a second proximal end 38. Second proximal end 38 is connected to frame 12. More specifically, second proximal end 38 is connected to rotatable rod 40. First distal end 36 of screen 20 is movable generally in the direction indicated by arrow B between a first limit position and a second limit position.

Referring now to FIG. 4, a pair of counterweights 42, 44 are illustrated. Counterweights 42, 44 are used to apply tension in the direction indicated by arrow B on the first distal ends 30, 36 of the third and fourth screens 18, 20, respectively. The counterweights 42, 44 are attached by a strap, belt or, cord, etc. by a series of pulleys to the respective first end 30, 36. Tension is, therefore, applied in the direction of arrow B to the respective first end, in a direction away from that screen's respective second end. Thus, the counterweights ensure that screens 18, 20 are pulled taut from their respective first ends.

Similarly, a strap 46 is attached to the first distal end of the first and second screens 14, 16. Straps 46 are also attached by a series of pulleys at their opposite end to a counterweight to apply tension in the first direction A to each of the first distal end of the first and second screens in a direction away from its respective second proximal end. For example, referring to FIG. 11, strap 46, which is connected to a counterweight at its distal end (not shown) applies tension in the direction indicated by arrow A. Thus, the counterweight ensures that screens 14, 16 are pulled taut from their respective first ends.

Referring now, once again, to FIG. 5, it can be seen that the first screen 14 and second screen 16 each gather near their respective second proximal ends 24, 28 when the first and second screens approach their first limit position. As illustrated in FIGS. 3, 6–8 and 11–14, a first guide channel 50 is fixedly connected to an upper portion of the frame. A second guide channel 52 is fixed to a lower portion of the frame. A third guide channel 54 is fixed to an upper portion of the frame and a fourth guide channel 56 is fixed to a lower portion of the frame 12.

Figure 6:
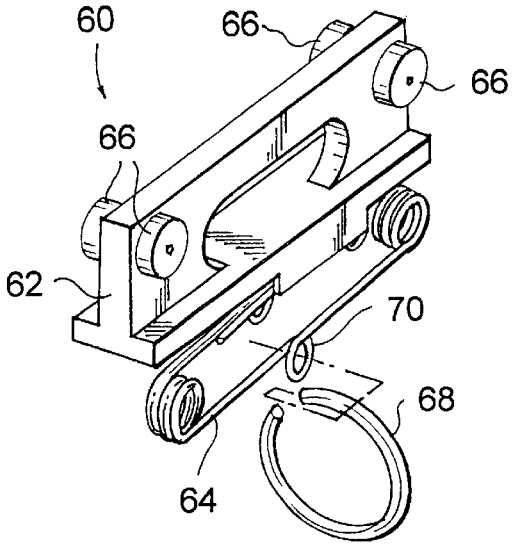
FIG. 6 is an upper perspective view of one of the support carriers and springs in accordance with the present invention.
Figure 7:
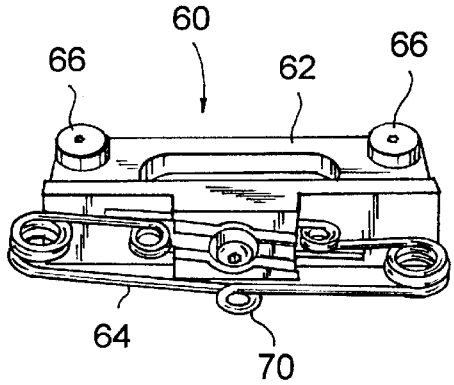
FIG. 7 is a lower perspective view of one of the support carriers and springs.
Figure 8:
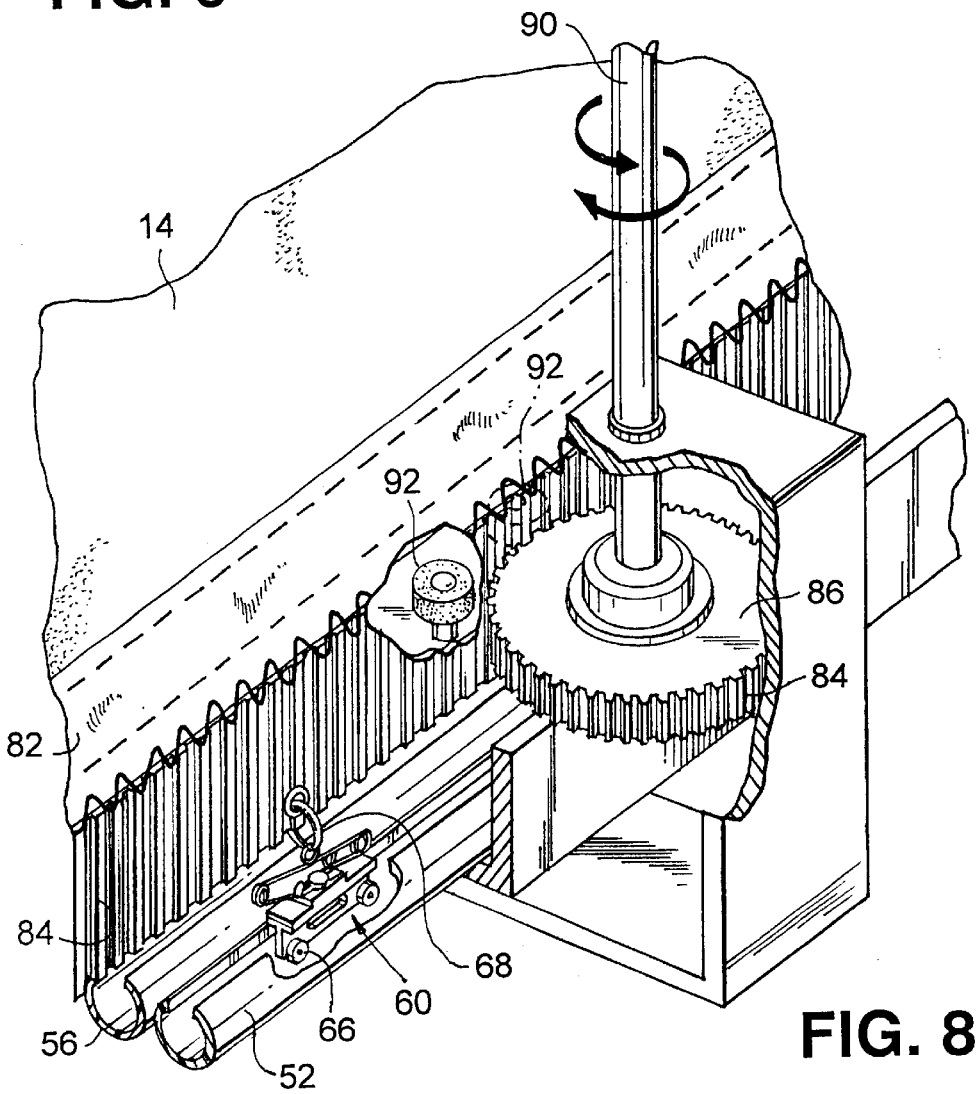
FIG. 8 is an enlarged detail view of detail circle 8 of FIG. 3 with parts broken away.
Figure 9:
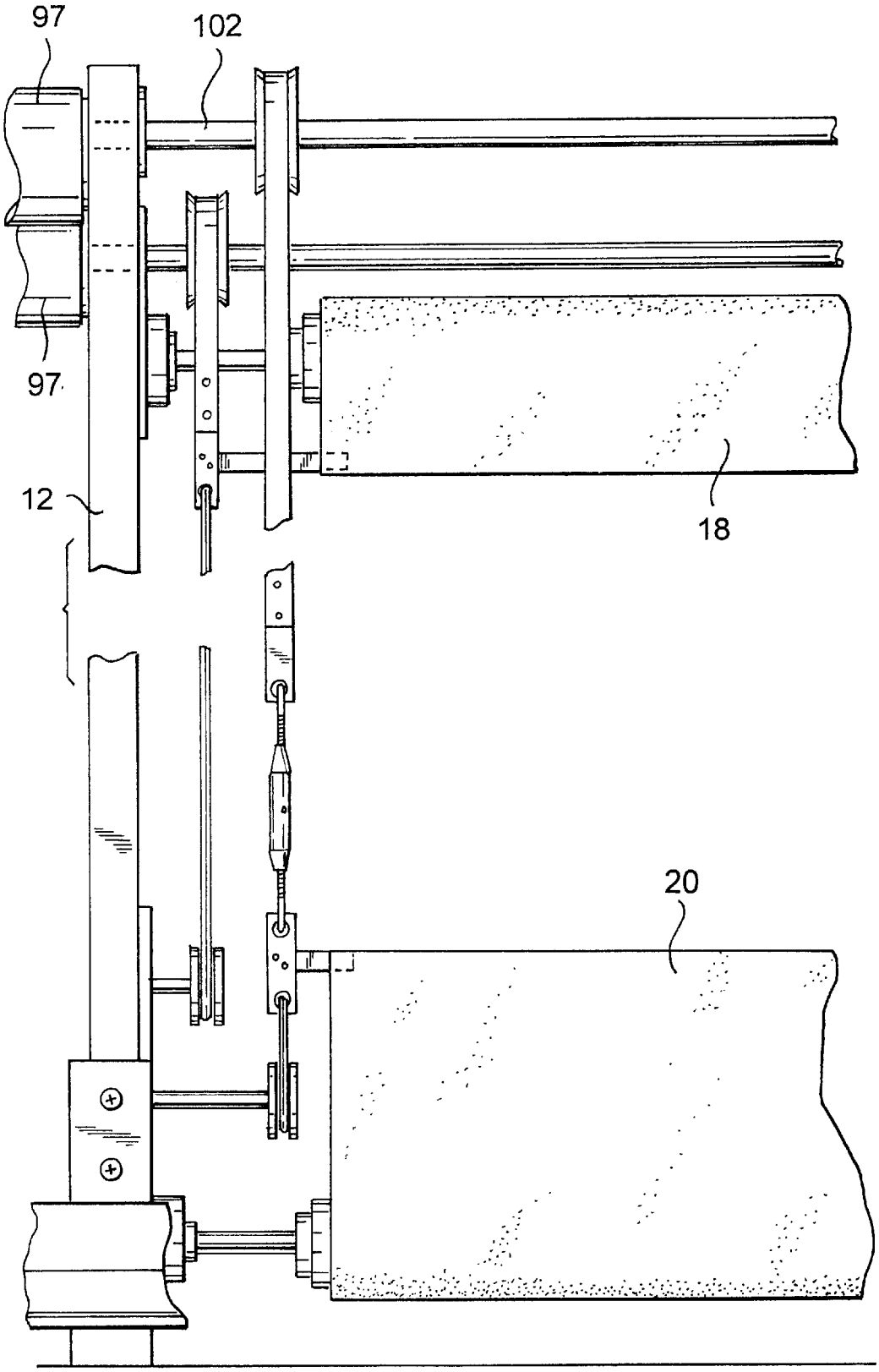
FIG. 9 is a partial cross-sectional view taken along line 9—9 of FIG. 3 and looking in the direction of the arrows.
Figure 10:
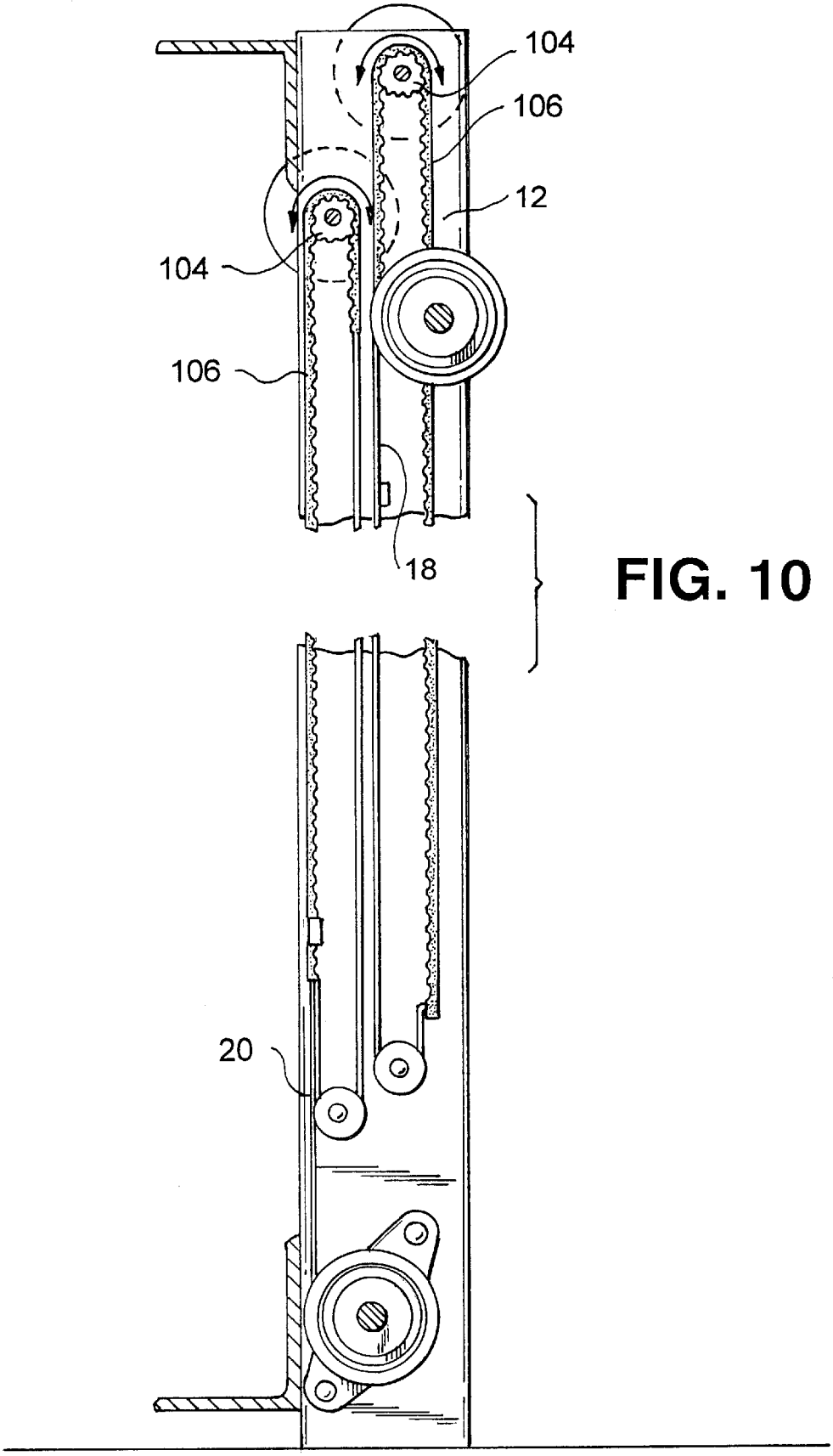
FIG. 10 is a partial cross-sectional view taken along line 10—10 of FIG. 3 and looking in the direction of the arrows.

Referring now to FIGS. 6 and 7, a support carrier 60 is illustrated. Support carrier 60 includes a mounting portion 62 and a spring portion 64. Four rollers 66 are rotatably attached about their axis to mounting portion 62. Mounting portion 62 has a predetermined length, which facilitates with the gathering and folding of screens 14, 16, to be described below. As illustrated in FIG. 6, a ring 68 is connected to the spring 64 by a loop 70 that is formed in part of the material (e.g., wire) that forms spring 64. As illustrated in FIG. 8, ring 68 is also attached to one of the first or second screens by an eyelet placed at either the top or bottom portion of the screen. Once assembled, the screen's position relative to the guides is adjusted so that the springs 64 at both the top and bottom of the screen are in tension so that their respective rollers 66 maintain contact with their respective guide channels 50, 52, 54, 56. First screen 14 has its upper support carriers traveling in guide track 50 and its lower support carriers traveling in guide track 52. Thus, second screen 16 has its upper support carriers traveling in upper guide track 54 and lower guide track 56. However, the positioning of the first and second screens could be reversed, if desired.

Figure 11:
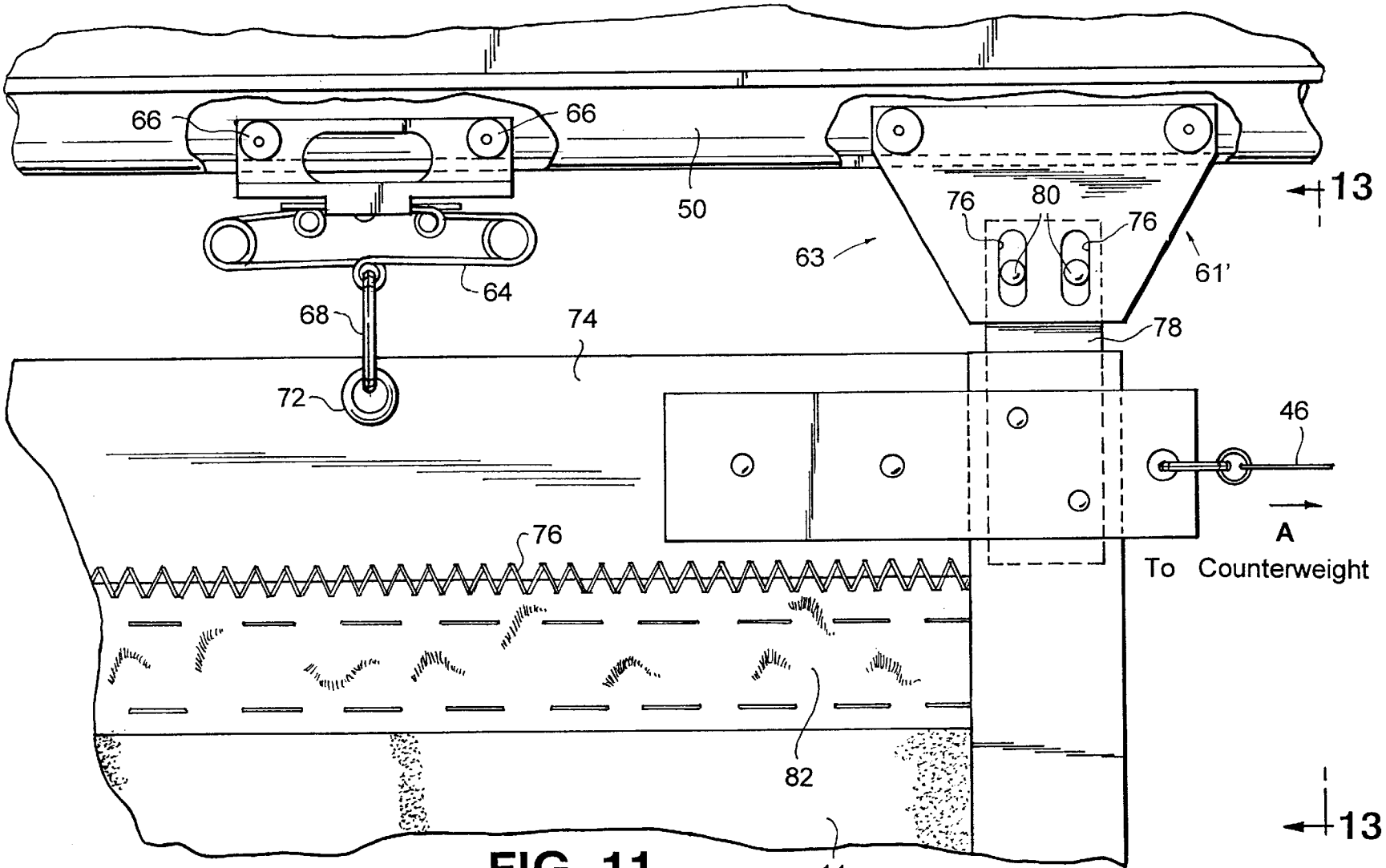
FIG. 11 is an enlarged detail view of detail circle 11 of FIG. 2 of an upper corner of one of the screens.
Figure 13:
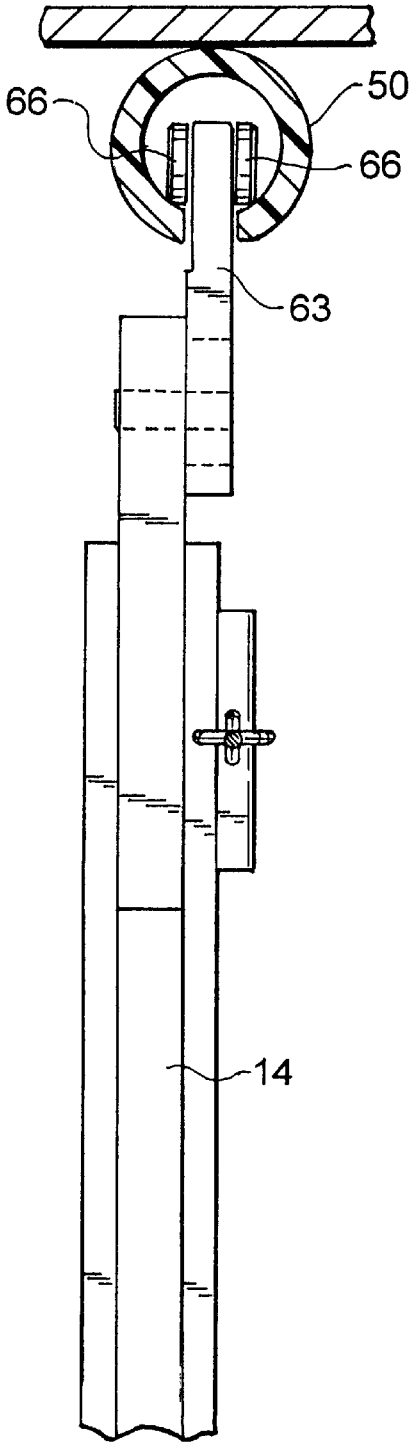
FIG. 13 is a cross-sectional view taken along line 13—13 of FIG. 11 and looking in the direction of the arrows.

In the currently preferred embodiment, the first and second screens each have a belt 74 that is connected at the top end of the screen. Preferably, belt 74 has its one edge abutted against the top end of the screen and is attached to the top end by stitching 75. As illustrated in FIG. 11, the leading support carrier 63 does not include a spring 64, but instead includes a pair of elongated slots 76. An extension tab 78 extends upwardly from belt 74 and includes projections 80 that are received within the elongated slot 76. Thereafter, a fastener can be used to maintain the positions of projections 80 with respect to leading support carrier 63 so that first screen 14 is in the desired position to ensure that tension is applied by springs 64, thereby maintaining rollers 66 in contact with respective fixed guide track 50, 54. As illustrated in FIGS. 11 and 13, leading support carrier 63 has four rollers that are received within guide tracks 50, 54.

Figure 12:
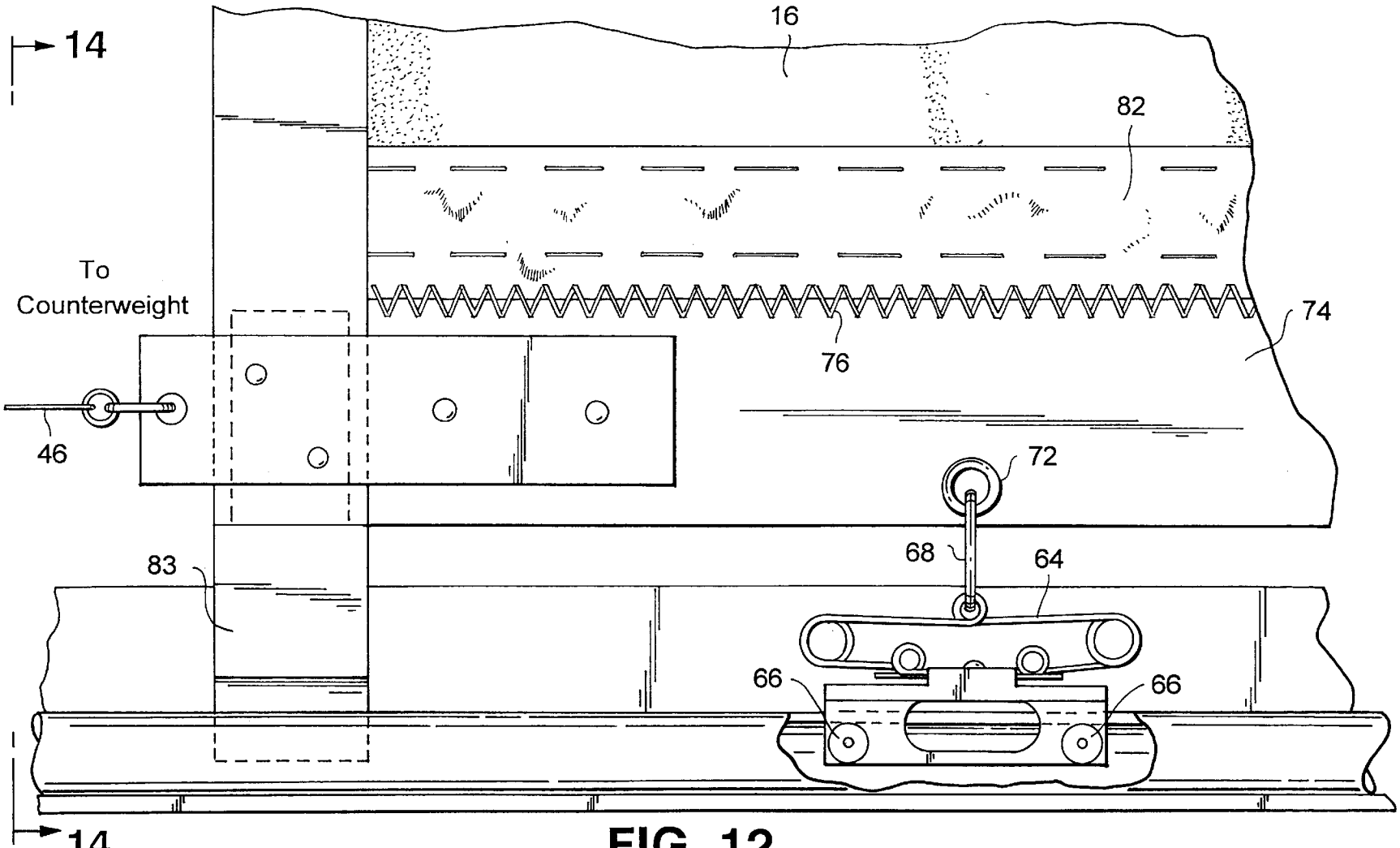
FIG. 12 is an enlarged detail view of detail circle 12 of FIG. 2 of a lower corner of one of the screens.
Figure 14:
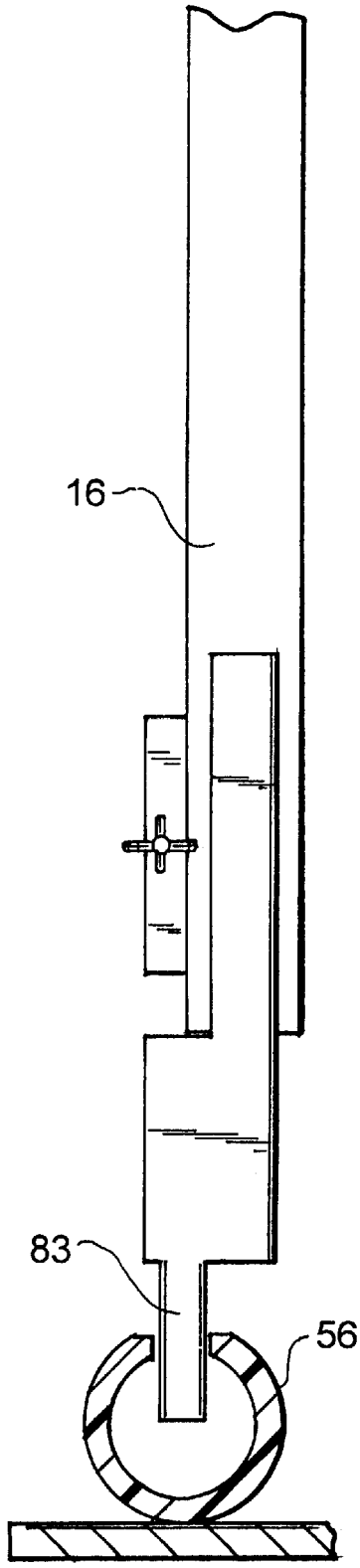
FIG. 14 is a cross-sectional view taken along line 14—14 of FIG. 12 and looking in the direction of the arrows.

Referring now to FIGS. 8, 12 and 14, a second belt 82 is connected to the lower end of the first and second screens 14, 16 in a manner similar to how first belt 74 is attached to the upper end of the first and second screens. However, lower belt 82 also has on one side thereof a rack of teeth 84 so that belt 82 and, therefore, the respective first and second screens 14, 16, may be driven linearly in the direction of arrow A. A drive gear 86 has a plurality of teeth 88 that mesh with the teeth 84 of the first belt 82. Drive gear 86 is fixedly connected to a drive shaft 90, as illustrated in FIGS. 3 and 8. Drive shaft 90 is rotatably driven by an electric motor 94 (see FIG. 2). The operation of electric motor 94 is controlled by a computer controller 95. A pair of idler pulleys 92 each engage the second, non-toothed side of belt 82 to ensure that the belt's teeth 84 engage with the teeth 88 of drive gear 86.

As illustrated in FIGS. 12 and 14, the leading edge of the lower end of screens 14, 16 each has a tab 83 extending downwardly from belt 82. The free end of tab 83 is received in the lower guide channel 52, 56. As illustrated in FIG. 14, tab 83 of screen 16 is received in lower guide track 56.

Referring now to FIGS. 3, 4, 9, and 10, the actuation mechanism for screens 18 and 20 is illustrated. A CPU or other computer controller 95 controls the actuation of motors 97, and, therefore, the actuation of screens 18, 20. The output shaft 102 of motor 97 has a gear 104 fixedly connected thereto. Gears 104 mesh with one side of a toothed belt 106. An end 108 of belt 106 is fixedly connected to a respective first distal end 30, 36 of screens 18, 20, preferably by stitching. A turnbuckle may be employed between the end of belt 106 and the first distal end of screens 18, 20 to adjust the length of belts 106. Thus, one skilled in the art will readily recognize that actuation of motors 97 causes screens 18, 20 to move between their first limit position and their second limit position.

Figure 15:
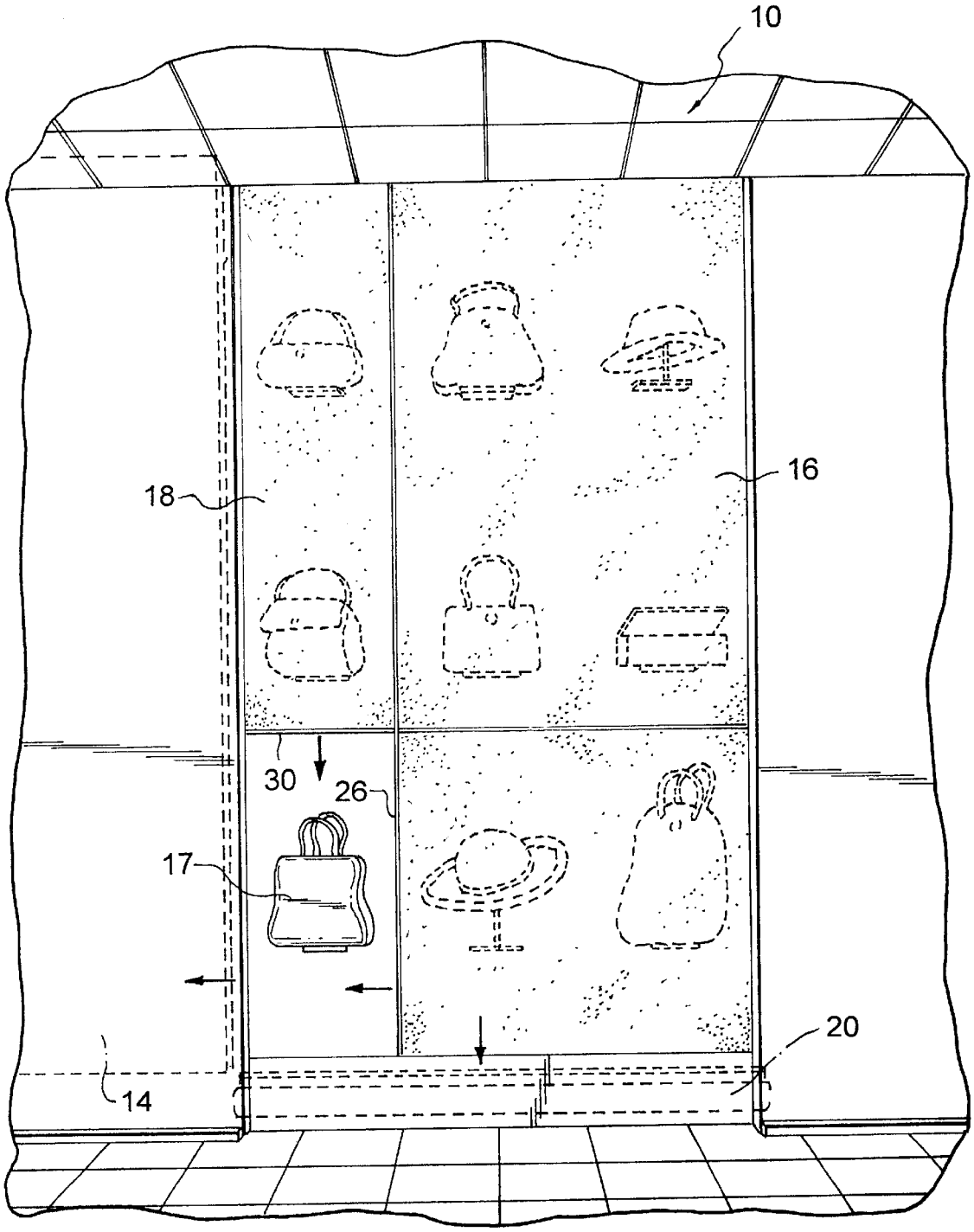
FIG. 15 is a plan view of the display device in one orientation in accordance with the present invention.
Figure 16:
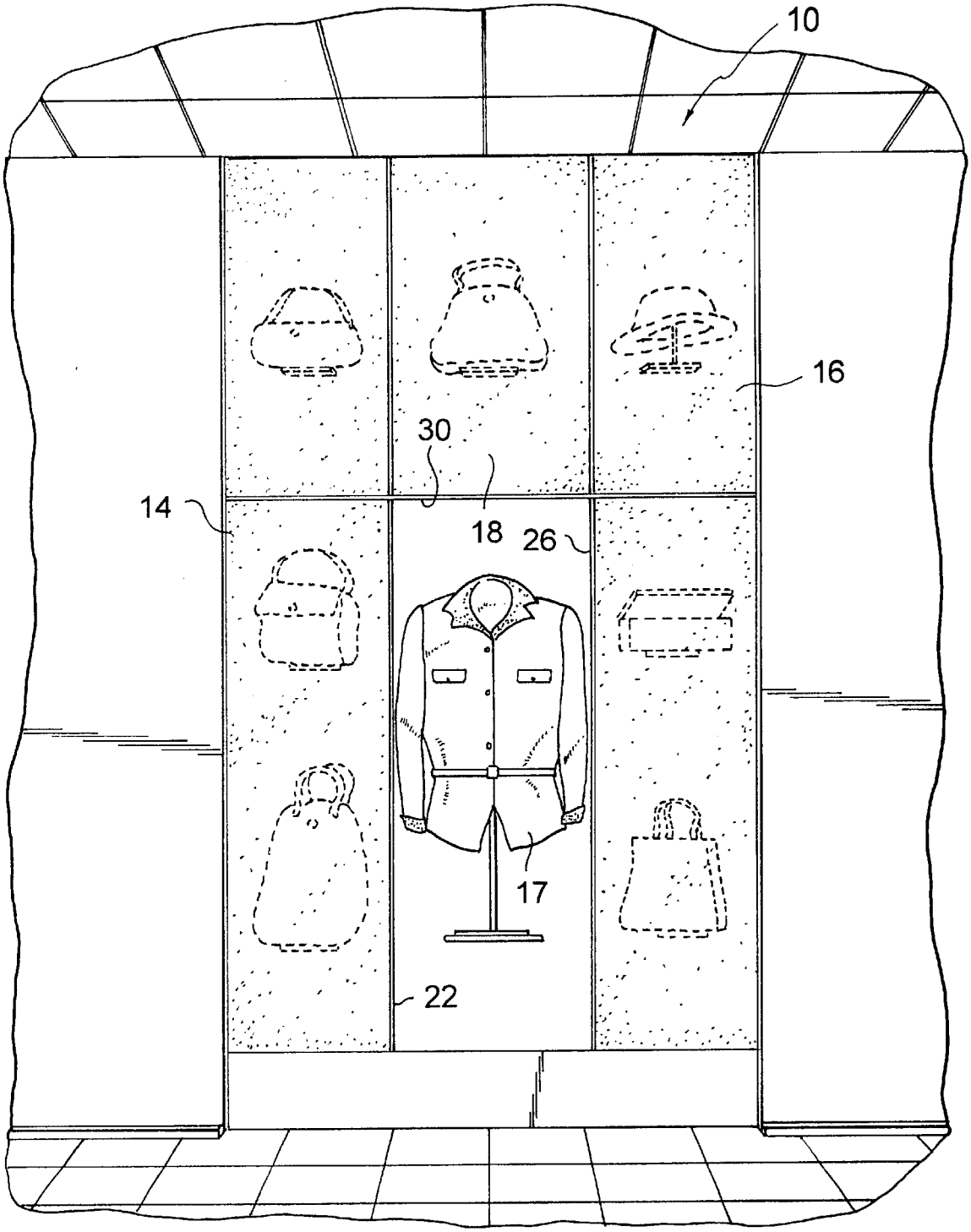
FIG. 16 is a plan view of the display device in another orientation in accordance with the present invention.

Referring now to FIGS. 1, 15 and 16, display device 10 is set up as an advertising display in a store to systematically display certain portions of display window 13 so that only certain merchandise 17, as desired, is revealed to the customer. The remaining merchandise will remain behind movable screens 14, 16, 18, and 20 that partially or completely block their view depending upon the openness of the screens. Screens 14, 16, 18, and 20 then move to another predetermined location to reveal different merchandise. Screens 14, 16, 18, and 20 can be moved in a predetermined manner to cyclically reveal the merchandise, or may be moved randomly.

The actuation of electric motors 94, 97 is controlled by a computer controller 95 and may be programmed to actuate depending upon the desires of the operator. FIGS. 1, 15, and 16 reveal three possible positions of screens 14, 16, 18, and 20 depending upon the actuation of motors 94, 97. Because the screens are held taut by their respective counterweights the start up and stopping of the screens is achieved smoothly without any substantial noise. Additionally, because the rollers 66 of the support carriers 60 are maintained in contact with their respective guide tracks, minimal noise is created during the movement of screens 14, 16.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A display device comprising:

a frame;

a first screen having a first distal end and a second proximal end, said second proximal end of said first screen connected to said frame, said first distal end of said first screen being movable generally in a first direction between a first limit position and a second limit position;

a second screen having a first distal end and a second proximal end, said second proximal end of said second screen connected to said frame, said first distal end of said second screen being movable generally in said first direction between a first limit position and a second limit position;

a third screen having a first distal end and a second proximal end, said second proximal end of said third screen connected to said frame, said first distal end of said third screen being movable generally in a second direction between a first limit position and a second limit position, said second direction being at an angle with respect to said first direction;

a fourth screen having a first distal end and a second proximal end, said second proximal end of said fourth screen connected to said frame, said first distal end of said fourth screen being movable generally in said second direction between a first limit position and a second limit position; and a first means for applying tension in said first direction to each of said first distal ends of each of said first screen and said second screen in a direction away from said respective second proximal end.

2. The display device in accordance with claim 1, further comprising a second means for applying tension in said second direction to each of said first distal end of each of said third screen and said fourth screen in a direction away from said respective second proximal end.

3. The display device in accordance with claim 1, wherein said first applying tension means includes a strap attached to said respective first distal end, said strap extending over at least one pulley and being connected to a counterweight.

4. The display device in accordance with claim 2, wherein said first and second applying tension means each includes a strap attached to said respective first and second distal end, said strap extending over at least one pulley and being connected to a counterweight.

5. The display device in accordance with claim 1, wherein each of said screens are made of partially open material.

6. The display device in accordance with claim 1, wherein said first screen gathers near said second proximal end when said first distal end is proximate said first limit position.

7. The display device in accordance with claim 6, wherein said first screen gathers in asymmetric folds.

8. The display device in accordance with claim 7, wherein said first screen is spaced from itself when gathered in said asymmetric folds.

9. A display device comprising:

a frame;

a first screen having a first distal end and a second proximal end, said second proximal end of said first screen connected to said frame, said first screen having a third top end and a fourth bottom end, said first distal end of said first screen being movable generally in a first direction between a first limit position and a second limit position;

a second screen having a first distal end and a second proximal end, said second proximal end of said second screen connected to said frame, said first distal end of said second screen being movable generally in said first direction between a first limit position and a second limit position;

a third screen having a first distal end and a second proximal end, said second proximal end of said third screen connected to said frame, said first distal end of said third screen being movable generally in a second direction between a first limit position and a second limit position, said second direction being at an angle with respect to said first direction;

a fourth screen having a first distal end and a second proximal end, said second proximal end of said fourth screen connected to said frame, said first distal end of said fourth screen being movable generally in said second direction between a first limit position and a second limit position; and a first guide channel fixedly connected to an upper portion of said frame;

a second guide channel fixedly connected to a lower portion said frame;

a first set of support carriers, each support carrier of said first set having at least one roller, said at least one roller being rotatably received in said first guide channel, a first set of springs, each of said springs of said first set connecting one of said first set of support carriers to said third top end of said first screen, said first set of springs each being in tension so that said at least one roller of each of said support carriers of said first set maintaining contact with said first guide channel;

a second set of support carriers, each support carrier of said second set having at least one roller, said at least one roller being rotatably received in said second guide channel, a second set of springs, each of said springs of said second set connecting one of said second set of support carriers to said fourth bottom end of said first screen, said second set of springs each being in tension so that said at least one roller of each of said support carriers of said second set maintaining contact with said second guide channel.

10. The display device in accordance with claim 9, further comprising:

a third guide channel fixedly connected to an upper portion of said frame;

a fourth guide channel fixedly connected to a lower portion said frame;

said second screen having a third top end and a fourth bottom end;

a third set of support carriers each support carrier of said third set having at least one roller, said at least one roller being rotatably received in said third guide channel, a third set of springs, each of said springs of said third set connecting one of said third set of support carriers to said third top end of said second screen, said third set of springs each being in tension so that said at least one roller of each of said support carriers of said third set maintaining contact with said third guide channel;

a fourth set of support carriers, each support carrier of said fourth set having at least one roller, said at least one roller being rotatably received in said fourth guide channel, a fourth set of springs, each of said springs of said fourth set connecting one of said fourth set of support carriers to said fourth bottom end of said second screen, said fourth set of springs each being in tension so that said at least one roller of each of said support carriers of said fourth set maintaining contact with said fourth guide channel.

11. The display device in accordance with claim 9, further comprising a first belt being fixed connected to said third top end of said first screen, each of said springs of said first set of support carriers being directly connected to said belt.

12. The display device in accordance with claim 11, wherein said first belt has a rack of teeth on a first side hereof.

13. The display device in accordance with claim 12, further comprising a drive gear being rotatably connected to said frame, said drive gear meshing with said teeth of said first belt to move said first screen in said first direction.

14. The display device in accordance with claim 13, further comprising at least one idler roller being rotatably connected to said frame, said at least one idler roller engaging a second side of said belt to maintain said drive gear in meshing engagement with said teeth of said first belt.

15. The display device in accordance with claim 10, further comprising a first belt being fixed connected to said third top end of said first screen, each of said springs of said first set of support carriers being directly connected to said belt.

16. The display device in accordance with claim 15, wherein said first belt has a rack of teeth on a first side hereof.

17. The display device in accordance with claim 16, further comprising a drive gear being rotatably connected to said frame, said drive gear meshing with said teeth of said first belt to move said first screen in said first direction.

18. The display device in accordance with claim 17, further comprising at least one idler roller being rotatably connected to said frame, said at least one idler roller engaging a second side of said belt to maintain said drive gear in meshing engagement with said teeth of said first belt.

19. The display device in accordance with claim 9, further comprising a third support carrier having a first and a second roller each being rotatably received in said first guide channel, said third support carrier having an elongated slot, said third support carrier being adjustably connected to said third top end of said first screen via said elongated slot.

20. The display device in accordance with claim 10, further comprising a third support carrier having a first and a second roller each being rotatably received in said first guide channel, said third support carrier having an elongated slot, said third support carrier being adjustably connected to said third top end of said first screen via said elongated slot.

21. The display device in accordance with claim 9, further comprising a first means for applying tension in said first direction to each of said first distal end of each of said first screen and said second screen in a direction away from said respective second proximal end.

22. The display device in accordance with claim 21, further comprising a second means for applying tension in said second direction to each of said first distal end of each of said third screen and said fourth screen in a direction away from said respective second proximal end.

23. The display device in accordance with claim 21, wherein said first applying tension means includes a strap attached to said respective first distal end, said strap extending over at least one pulley and being connected to a counterweight.

24. The display device in accordance with claim 22, wherein said first and second applying tension means each includes a strap attached to said respective first and second distal end, said strap extending over at least one pulley and being connected to a counterweight.

25. The display device in accordance with claim 21, wherein each of said screens are made of partially open material.

26. The display device in accordance with claim 21, wherein said first screen gathers near said second proximal end when said first distal end is proximate said first limit position.

27. The display device in accordance with claim 26, wherein said first screen gathers in asymmetric folds.

28. The display device in accordance with claim 27, wherein said first screen is spaced from itself when gathered in said asymmetric folds.

29. The display device in accordance with claim 1, wherein said first applying tension means includes a strap attached to said respective first distal end, said strap extending over at least one pulley and being connected to a tensioning device.

30. The display device in accordance with claim 2, wherein said first and second applying tension means each includes a strap attached to said respective first and second distal end, said strap extending over at least one pulley and being connected to a tensioning device.

31. The display device in accordance with claim 22, wherein said first and second applying tension means each includes a strap attached to said respective first and second distal end, said strap extending over at least one pulley and being connected to a tensioning device.

* * * * *